US008833128B2

(12) United States Patent
Flehmig et al.

(10) Patent No.: US 8,833,128 B2
(45) Date of Patent: Sep. 16, 2014

(54) METHOD FOR PRODUCING SLIT HOLLOW PROFILES

(71) Applicants: Thomas Flehmig, Ratingen (DE); Michael Brüggenbrock, Rosendahl (DE)

(72) Inventors: Thomas Flehmig, Ratingen (DE); Michael Brüggenbrock, Rosendahl (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 14/104,735

(22) Filed: Dec. 12, 2013

(65) Prior Publication Data

US 2014/0096579 A1 Apr. 10, 2014

Related U.S. Application Data

(63) Continuation of application No. PCT/EP2012/061002, filed on Jun. 11, 2012.

(30) Foreign Application Priority Data

Jun. 17, 2011 (DE) ..... 10 2011 051 160

(51) Int. Cl.

| | |
|---|---|
| ***B21D 37/06*** | (2006.01) |
| ***B21D 51/28*** | (2006.01) |
| ***B21D 9/10*** | (2006.01) |
| ***B21C 37/06*** | (2006.01) |
| ***B21C 37/08*** | (2006.01) |

(52) U.S. Cl.

CPC ..... *B21C 37/065* (2013.01); *B12D 5/015* (2013.01); *B21C 37/0815* (2013.01)

USPC ..... 72/367.1; 72/307.24

(58) Field of Classification Search

USPC ..... 72/51, 56, 57, 61, 62, 367.1, 370, 381, 72/394, 395

See application file for complete search history.

(56) References Cited

U.S. PATENT DOCUMENTS

| | | | | |
|---|---|---|---|---|
| 5,499,580 | A * | 3/1996 | Hoffmann et al. | 72/368 |
| 6,266,858 | B1 * | 7/2001 | Mashiko et al. | 72/396 |
| 8,505,352 | B2 * | 8/2013 | Flehmig et al. | 72/352 |
| 2008/0092615 | A1 * | 4/2008 | Bruggernbrock | 72/51 |
| 2013/0061541 | A1 * | 3/2013 | Taylor et al. | 72/130 |
| 2013/0327116 | A1 * | 12/2013 | Suto et al. | 72/368 |

FOREIGN PATENT DOCUMENTS

| | | | |
|---|---|---|---|
| DE | 85 36 655.2 | U1 | 2/1986 |
| DE | 100 45 938 | C1 | 10/2001 |
| DE | 100 62 836 | A1 | 6/2002 |

(Continued)

*Primary Examiner* — David B Jones

(74) *Attorney, Agent, or Firm* — Reinhart Boerner Van Deuren P.C.

(57) ABSTRACT

A method for producing slit hollow profiles from a cut blank is provided, in which the hollow profile is produced from the essentially flat blank using rolling-up technology or using U-O-forming, so that the hollow profile has a slit in the axial direction along the abutting edges of the formed blank. Highly dimensionally stable, slit hollow profiles can be produced which can be easily joined to form closed hollow profiles, is achieved by the cut blank providing a circumferential length in the locally provided cross-sectional areas which is greater than the required forming length, so that when the cut blank is formed into a closed hollow profile the opposite edges of the formed cut blank abut on one another and when it is formed into the final shape at least the areas of the hollow profile abutting on the edge joint are at least partly compressed in the circumferential direction.

6 Claims, 2 Drawing Sheets

(56) References Cited

FOREIGN PATENT DOCUMENTS

| | | | |
|---|---|---|---|
| DE | 103 29 424 | B4 | 4/2005 |
| DE | 10 2007 007 810 | A1 | 9/2007 |
| DE | 10 2009 003 668 | A1 | 9/2010 |
| EP | 1 541 252 | A1 | 6/2005 |
| JP | 59-199117 | | 11/1984 |
| JP | 2005-169486 | | 6/2005 |
| WO | WO 2007/062991 | A1 | 6/2007 |

* cited by examiner

METHOD FOR PRODUCING SLIT HOLLOW PROFILES

CROSS-REFERENCE TO RELATED PATENT APPLICATIONS

This patent application is a continuation of PCT/EP2012/061002, filed Jun. 11, 2012, which claims priority to German Application No. 102011051160.1, filed Jun. 17, 2011, the entire teachings and disclosure of which are incorporated herein by reference thereto.

FIELD OF THE INVENTION

The invention relates to a method for producing slit hollow profiles from a cut blank, in which the hollow profile is produced from the essentially flat blank using rolling-up technology or using U-O-forming, so that the hollow profile has a slit in the axial direction along the abutting edges of the formed blank, wherein the cut blank providing a circumferential length in the locally provided cross-sectional areas which is greater than the required forming length, so that when the cut blank is formed into a closed hollow profile the opposite edges of the formed cut blank abut on one another and when it is formed into the final shape at least the areas of the hollow profile abutting on the edge joint are at least partly compressed in the circumferential direction.

BACKGROUND OF THE INVENTION

The production of slit hollow profiles, so-called slit profiles, which are produced from an essentially flat blank using U-O-forming or using rolling-up technology, which is also known under the name InnForm $T^3$® technology of the applicant, and are joined in a firmly bonded manner along the longitudinal slit, is known from the prior art. Rolling-up technology (InnForm $T^3$) is taken to mean producing a hollow profile from a cut blank using a multi-stage press, single presses or press lines, for example as a follow-on composite, wherein the presses usually form the mostly flat cut blank by means of metal forming and bending operations with or without the use of a forming core. In the case of U-O-forming, usually an essentially flat cut blank is firstly formed into a U-shape using a corresponding punch and a lower die and is then formed into an O-shape using a second upper die. U-O-forming can also be carried out in press lines. However, when using both rolling-up technology and U-O-forming, springbacks and elastic and/or plastic distortions occur in the sheet plane, so that there is not the sufficient shape and dimensional stability required when it is joined to form a closed hollow profile. The springbacks and distortions of the blank material, which increasingly occur particularly in higher-strength and super high-strength steels, result in deviations from the desired contour occurring at the joint edge before welding. As a result, the slit of the hollow profile exhibits deviations from its desired width, for example, so that problems can occur when welding the slit hollow profiles.

It is known from the German patent specification DE 103 29 424 B4 to choose the cut blank when producing hollow profiles with a variable cross-section in the longitudinal direction in such a way that an excess of material or a shortage of material is provided in the transition areas, so that when it is formed into a hollow profile no material thickenings or attenuations occur at the transition areas. In contrast, the German patent specification DE 100 45 938 C1 relates to a method for producing closed hollow profiles, in which the edges of the cut blank which are opposite one another can be brought fully edge to edge, so that they can be welded easily without using filler materials. This is achieved by firstly bending or roll forming the cut blank in a forming-bending tool, so that the longitudinal edges of the blank are brought edge to edge. During this bending or roll-forming process, the sheet blank is compressed via an axial punch in the axial direction, so that the abutting edges are perfectly in contact edge to edge and a circumferential bulge is produced in the truncated cone sections of the hollow profile. However, this axial compression requires an additional axial punch and principally a further production step.

Taking this prior art as the starting point, the object forming the basis of the present invention is to provide a method for producing closed hollow profiles, by means of which method highly dimensionally stable, slit hollow profiles can be simply produced which can be easily joined to form closed hollow profiles.

SUMMARY OF THE INVENTION

According to the teaching of the present invention, the object is achieved by distributing the excess length of the circumferential length symmetrically over both edge areas.

Both when using rolling-up technology (InnForm $T^3$®) and when using U-O-forming, it has become apparent that compression of the slit hollow profile carried out in the circumferential direction during the metal forming process results in a clean formation of the edge joint of the hollow profile and the springback of the finished part is minimised. For this purpose, the cut blank is to be chosen in the for example locally provided cross-sectional areas in such a way that the cut blank in these areas provides a circumferential length which is greater than the required forming length. The forming length is the dimension of the cut blank which corresponds to the locally provided circumference. A compression in the circumferential direction of the blank is hereby automatically obtained when using rolling-up technology or U-O-forming, wherein at least the areas of the hollow profile abutting directly on the edge joint are compressed. This is sufficient to distinctly minimise the springback and produce a clean edge joint on the slit hollow profile.

According to the invention, the excess length is symmetrically distributed over both edge areas, in order to make forming of the cut blank and compression of the hollow profile easier.

According to a first embodiment of the method according to the invention, a dimensionally stable edge joint of the slit hollow profile can be provided by the excess length of the circumferential length of the cut blank in the locally provided cross-sectional areas being at least 1% to 10%, preferably 2% to 5% of the required forming length. The nominal circumferential length in the locally provided cross-sectional areas corresponds to the circumference actually required to provide the cross-sectional area in this area.

The method according to the invention can be further improved by compressing the hollow profile over its entire cross-section. This is particularly the case if the hollow profile has a round cross-sectional area, for example a circular or an elliptical cross-sectional area.

According to a subsequent embodiment of the method according to the invention, the hollow profile is compressed along the entire edge joint. The springback of the hollow profile can hereby be reduced over the entire axial length of the edge joint and thereby a highly dimensionally stable edge joint can be provided.

If the produced hollow profile at least in certain areas has a round cross-section, then the hollow profile can be compressed in these areas over the entire cross-section via the method according to the invention.

According to a further embodiment of the method according to the invention, the produced hollow profile at least in certain areas has a box-shaped or cornered cross-section, so that in particular at least the areas of the hollow profile which abut on the edge joint can be compressed using the method according to the invention and also a highly dimensionally stable edge joint can be provided.

The method according to the invention is applicable to any cross-section shape, wherein also any combinations viewed in the longitudinal direction, for example round/elliptical/box-shaped, are possible. The excess length, in particular in conjunction with the tool design, can also be dimensioned in such a way that it has a springback-minimising effect in all other areas.

Finally, the method can be further developed such that the slit of the hollow profile provided on the edge joint is welded after the forming operation, in particular using a laser beam. Due to the highly dimensionally stable edge joints, which can be achieved using the method according to the invention, with the production method according to the invention it is immaterial whether the closed hollow profile to be produced has different cross-sectional areas in certain places. That is to say, irrespective of how even the cross-sectional area itself is formed, via the method according to the invention the areas of the hollow profile participating in the edge joint are compressed and hence the edge joint is formed in a dimensionally stable manner.

BRIEF DESCRIPTION OF THE DRAWINGS

The invention is, in addition, to be explained in more detail by means of exemplary embodiments in conjunction with the figures.

DETAILED DESCRIPTION OF THE INVENTION

Figure 1:
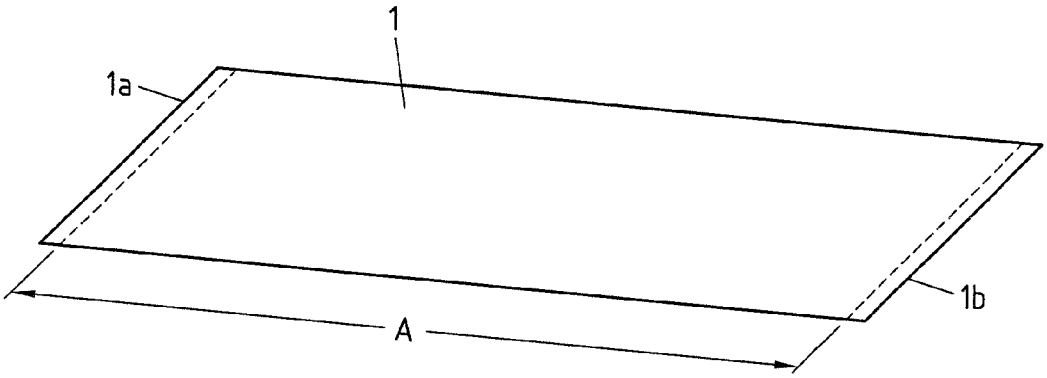
FIG. 1 shows in perspective illustration a schematic view of a cut blank for producing a tubular hollow profile.
Figure 2:
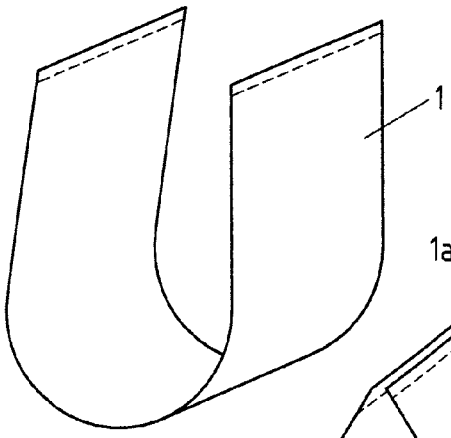
FIG. 2 to FIG. 4 show the cut blank from FIG. 1 in the different forming stages of a U-O-forming operation likewise in perspective illustration.
Figure 3:
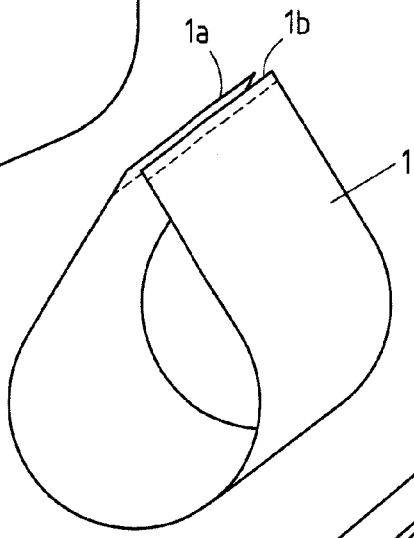
Figure 4:
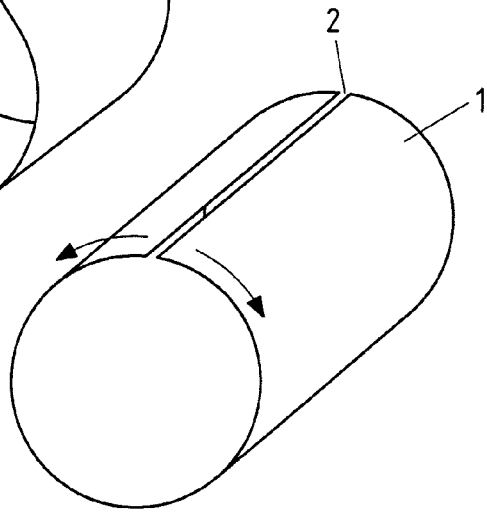

Firstly, in FIG. 1 in a perspective illustration a cut blank 1 is shown which has an excess length at the edge areas 1*a*, 1*b* which form the subsequent edge joint of the hollow profile. Length A indicates the required forming length, i. e. the circumferential length of the blank, which is required for providing the cross-sectional area. In FIGS. 2, 3 and 4, the individual forming steps for U-O-forming the cut blank 1 are now shown in perspective illustration. The cut blank 1 is initially formed into a U-shape, FIG. 2. This is usually carried out with a first die half using a punch which forms the flat cut blank 1 into the U-shape. During further forming of the cut blank, as shown in FIG. 3, the U-shape is firstly closed. This is often achieved by using an upper die half, so that the edge areas 1*a*, 1*b* of the cut blank 1 butt against one another. When the cut blank 1 is formed into the final shape, as shown in FIG. 4, the edge areas 1*a*, 1*b* abut onto one another and lead to a compression of the hollow profile over the entire cross-section. Due to the compression, the springback of the cut blank is greatly reduced, so that a particularly dimensionally stable longitudinal slit 2 of the hollow profile can be provided. The compression of the hollow profile takes place in the circumferential direction, as the arrows in FIG. 4 indicate. The longitudinal slit 2 is particularly suitable for carrying out laser beam welding, since laser beam welding due to the limited extension of the weld zone makes special demands on the dimensional stability of the slit. As can be gathered from FIG. 4, the cut blank 1 formed into a hollow profile with a longitudinal slit is compressed over its entire axial length in the circumferential direction. However, it is also conceivable for the cut blank 1 only to be compressed in the areas which are required for providing a longitudinal slit to be welded.

Figure 5:
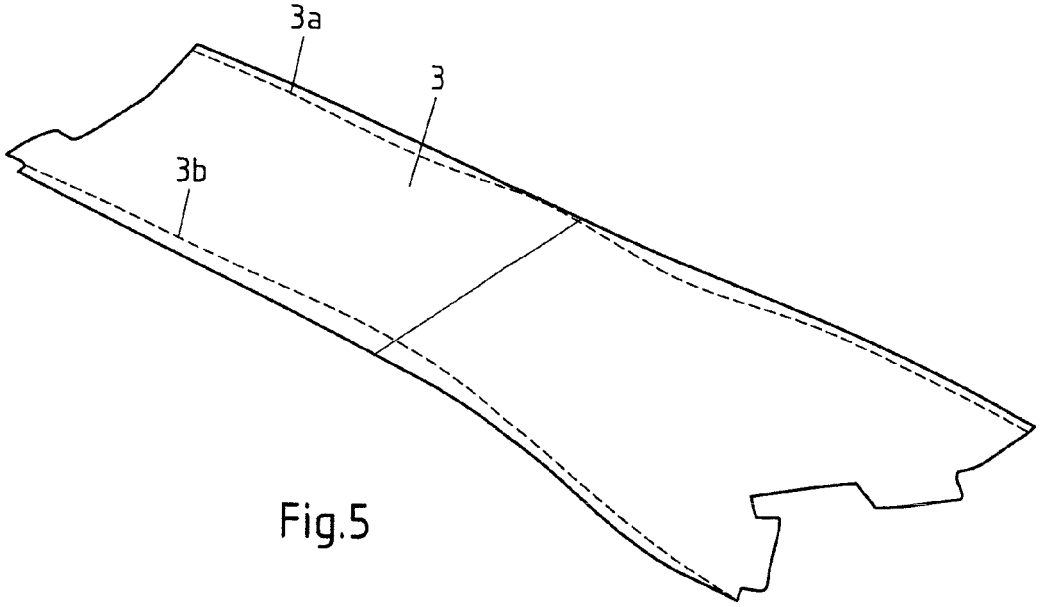
FIG. 5 shows in perspective illustration a cut blank for producing a hollow profile using rolling-up technology (Inn-Form T$^3$®) and FIG. 6 shows in a perspective illustration the cut blank from FIG. 5 formed into a complex hollow profile before the final forming step using rolling-up technology.

FIG. 5 shows a further exemplary embodiment of a cut blank 3 in a perspective illustration. The cut blank 3 is intended for the application of rolling-up technology. In the case of rolling-up technology, an essentially flat cut blank is formed into a hollow profile using a multi-stage press, single presses or press lines preferably using a forming core 4. In FIG. 5, the circumferential length which provides the local cross-section is indicated by 3*a*, 3*b*. The edge areas of the cut blank 3 lying beyond it are used according to the invention to compress the cut blank when the cut blank 3 is formed into the final shape.

As can be gathered from FIG. 5, the excess length of the cut blank 3 can be varied in the circumferential direction variably dependent on the shape of the hollow profile to be produced. It has become apparent that choosing an excess length in the circumferential length of the cut blank of at least 1% to 10% of the required circumferential length or the forming length, preferably 2% to 5% of the required forming length, produces particularly good results with respect to providing highly dimensionally stable hollow profiles with longitudinal slits.

Figure 6:
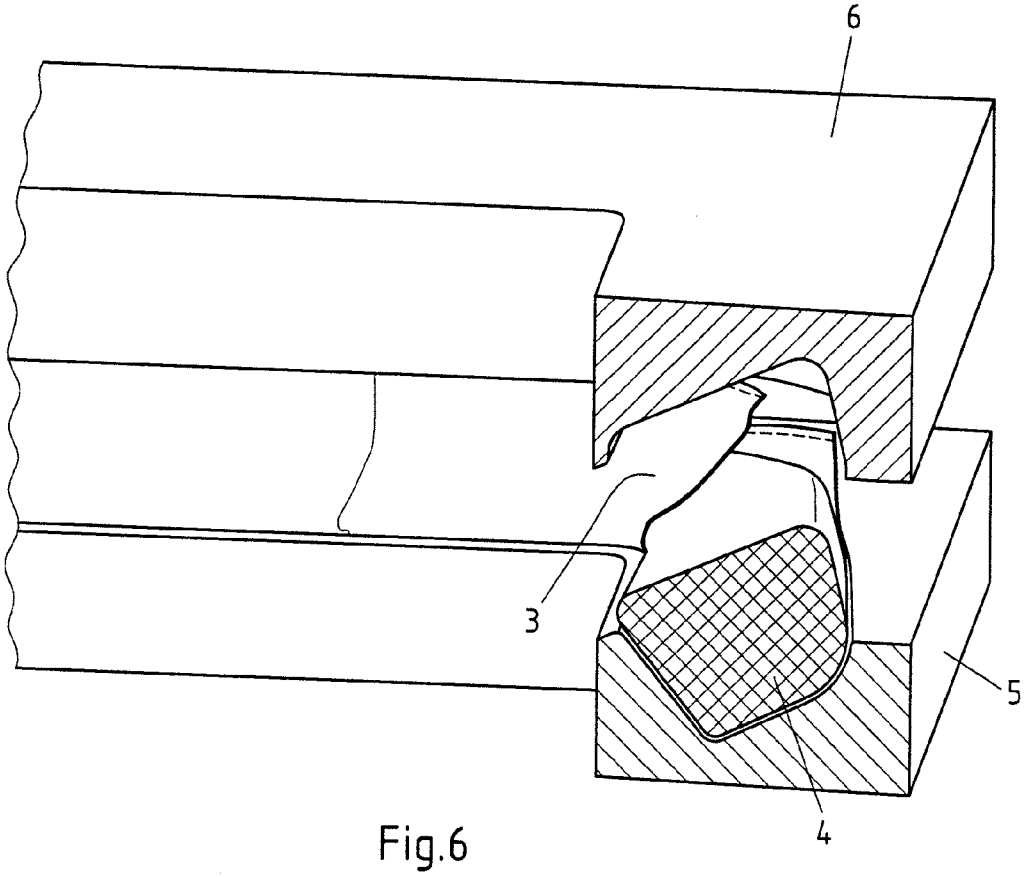

Finally, in FIG. 6 the cut blank 3, already formed into a pre-formed blank, is illustrated which by using a forming core 4, a lower die half 5 and an upper die half 6 is formed into the final shape. The excess length of the cut blank provided over the axial length in the circumferential direction is used to compress the hollow profile to be produced before forming it into the final shape, so that the springback when forming the cut blank into a slit hollow profile is distinctly reduced.

The invention claimed is:

1. Method for producing slit hollow profiles from a cut essentially flat blank, comprising producing the hollow profile from the essentially flat blank using rolling-up technology or using U-O-forming, so that the hollow profile has a slit running in the axial direction along the abutting edges of the formed blank, wherein the cut blank provides a circumferential length in the locally provided cross-sectional areas which is greater than the required forming length, so that when the cut blank is formed into a closed hollow profile the opposite edges of the formed cut blank abut on one another and when it is formed into the final shape at least the areas of the hollow profile abutting on the edge joint are at least partly compressed in the circumferential direction, wherein the excess length of the circumferential length of the cut blank is distributed symmetrically over both edge areas; and wherein the excess length of the circumferential length of the cut blank in the locally provided cross-sectional areas is at least 2% to 5% of the required forming length.

2. Method according to claim 1, wherein the hollow profile is compressed over its entire cross-section.

3. Method according to claim 1, wherein the hollow profile is compressed along the entire edge joint.

4. Method according to claim 1, wherein the produced hollow profile at least in certain areas has a round cross-section.

5. Method according to claim 1, wherein the produced hollow profile at least in certain areas has a box-shaped or cornered cross-section and the increased circumferential length is provided at least in the areas which abut on the edge joint.

6. Method according to claim 1, wherein the slit of the hollow profile provided on the edge joint is welded after the forming, in particular is welded using a laser beam.

* * * * *